US010889014B2

(12) United States Patent
Wei

(10) Patent No.: US 10,889,014 B2
(45) Date of Patent: Jan. 12, 2021

(54) ROLLING UTILITY KNIFE

(71) Applicant: APEX BRANDS, INC., Apex, NC (US)

(72) Inventor: Zixuan Wei, Shanghai (CN)

(73) Assignee: APEX BRANDS, INC., Apex, NC (US)

( * ) Notice: Subject to any disclaimer, the term of this patent is extended or adjusted under 35 U.S.C. 154(b) by 0 days.

(21) Appl. No.: 16/607,868

(22) PCT Filed: Apr. 24, 2018

(86) PCT No.: PCT/US2018/029033
§ 371 (c)(1),
(2) Date: Oct. 24, 2019

(87) PCT Pub. No.: WO2018/200445
PCT Pub. Date: Nov. 1, 2018

(65) Prior Publication Data

US 2020/0189130 A1 Jun. 18, 2020

Related U.S. Application Data

(60) Provisional application No. 62/489,783, filed on Apr. 25, 2017.

(51) Int. Cl.

| | |
|---|---|
| ***B26B 5/00*** | (2006.01) |
| ***B25G 1/08*** | (2006.01) |
| *B26B 3/08* | (2006.01) |

(52) U.S. Cl.
CPC ..... *B26B 5/003* (2013.01); *B25G 1/08* (2013.01); *B26B 3/08* (2013.01); *B26B 5/005* (2013.01)

(58) Field of Classification Search
CPC ..... B26B 5/003; B26B 5/005; B26B 3/08; B25G 1/08
See application file for complete search history.

(56) References Cited

U.S. PATENT DOCUMENTS 1,586,646 A * 6/1926 Blevin ..... B26B 27/005 30/2
2,537,287 A * 1/1951 Thomas ..... B26B 5/00 30/294
4,001,936 A * 1/1977 Matsushita ..... B26B 5/005 30/287
4,884,342 A * 12/1989 McNamara ..... B26B 5/002 30/162
5,301,428 A * 4/1994 Wilcox ..... B26B 5/001 30/125

(Continued)

OTHER PUBLICATIONS

International Search Report and Written Opinion of PCT/US2018/029033 dated Jul. 7, 2018, all enclosed pages cited.

*Primary Examiner* — Sean M Michalski
(74) *Attorney, Agent, or Firm* — Burr & Forman, LLP

(57) ABSTRACT

A utility knife (100) includes a body portion (120) including a sleeve portion (124) at a first end thereof and a heel portion (122) at a second end thereof, and a blade (110) that extends from the sleeve portion. The body portion includes a wheel assembly (140) including a wheel (142) rotatably disposed about a hub (146). The wheel is configured to support the utility knife during a cutting operation relative to a material being cut. The wheel is disposed on the hub to enable axial movement of the wheel to change an alignment of the wheel relative to the blade.

18 Claims, 7 Drawing Sheets

(56) References Cited

U.S. PATENT DOCUMENTS

| | | | | |
|---|---|---|---|---|
| 6,484,404 | B1 * | 11/2002 | Kao | B26B 29/06 30/162 |
| 6,748,659 | B1 * | 6/2004 | Street | B26B 5/005 30/162 |
| 7,051,443 | B2 * | 5/2006 | Mueller | B26B 5/00 30/125 |
| 7,055,249 | B1 * | 6/2006 | Chao-Huan | B26B 5/00 30/330 |
| D536,593 | S * | 2/2007 | Fraga | B26B 5/005 D8/99 |
| D537,699 | S * | 3/2007 | Fraga | B26B 5/005 D8/99 |
| 7,526,865 | B2 * | 5/2009 | Mueller | B26B 5/00 30/123 |
| 8,495,818 | B1 * | 7/2013 | Peppett | B26B 29/00 30/280 |
| 9,308,655 | B2 * | 4/2016 | Peppett | B26B 5/005 |
| 9,321,181 | B2 * | 4/2016 | Peppett | B26B 5/005 |
| D825,260 | S * | 8/2018 | Wei | B26B 5/005 D7/401.2 |
| 2004/0250425 | A1 * | 12/2004 | Arent | B26B 5/005 30/142 |
| 2005/0034309 | A1 * | 2/2005 | Arent | B26B 5/00 30/123 |

* cited by examiner

ROLLING UTILITY KNIFE

CROSS REFERENCE TO RELATED APPLICATION

This application claims priority to U.S. application No. 62/489,783 filed Apr. 25, 2017, the entire contents of which are hereby incorporated by reference in its entirety.

TECHNICAL FIELD

Example embodiments generally relate to utility knives and, in particular, relate to a utility knife having a rolling wheel for providing stability during a cutting operation.

BACKGROUND

Utility knives are commonly used to enable users to cut through various materials with relative ease. A utility knife typically includes a thin, razor sharp blade that is retractable into the handle of the knife. The handle of the knife often includes some slidable member that can be moved to position the blade at a desired amount of protrusion outside of the handle or retract the blade entirely.

A standard utility knife can be used to cut rough surfaces such as shingles or carpet backing. However, such surfaces can easily damage the knuckles or other portions of the hand of the operator during the cutting process if contact is made between the hand of the operator and the cutting surface. Although the use of gloves can mitigate this issue, gloves are not always used and may not be practical for use in all situations. Thus, it may be desirable to provide the operator with some form of protection for the hand during use of the knife.

Another potential shortcoming of a standard utility knife is that it may be difficult to maintain a straight cut while cutting some materials. In this regard, when the only contact point between the knife and the material being cut is at the blade itself, quick and accurate cutting may be difficult to achieve, particularly for rough surfaces or surfaces that do not have uniform resistance to cutting (such as shingles and carpet). Thus, it may also be desirable to provide design upgrades that can improve the ability of an operator to make long, straight cuts that can be accomplished with both speed and accuracy.

BRIEF SUMMARY OF SOME EXAMPLES

Some example embodiments may enable the provision of a rolling knife that includes an integrated wheel that allows, for example, two contact points (e.g., at the blade and at the wheel) between the knife and the surface being cut. The structure of the rolling knife may simultaneously offer improved protection for the knuckles of the operator and improved ability for users to make long, straight cuts on various types of materials.

In an example embodiment, a utility knife is provided. The utility knife may include a body portion including a sleeve portion at a first end thereof and a heel portion at a second end thereof, and a blade that extends from the sleeve portion. The body portion may include a wheel assembly including a wheel rotatably disposed about a hub. The wheel may be configured to support the utility knife during a cutting operation relative to a material being cut. The wheel may be disposed on the hub to enable axial movement of the wheel to change an alignment of the wheel relative to the blade.

In another example embodiment, a wheel assembly of a utility knife is provided. The utility knife may include a body portion including a sleeve portion at a first end thereof and a heel portion at a second end thereof, and a blade that extends from the sleeve portion. The wheel assembly may include a hub and a wheel rotatably disposed about the hub. The wheel may be configured to support the utility knife during a cutting operation relative to a material being cut. The wheel may be disposed on the hub to enable axial movement of the wheel to change an alignment of the wheel relative to the blade.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
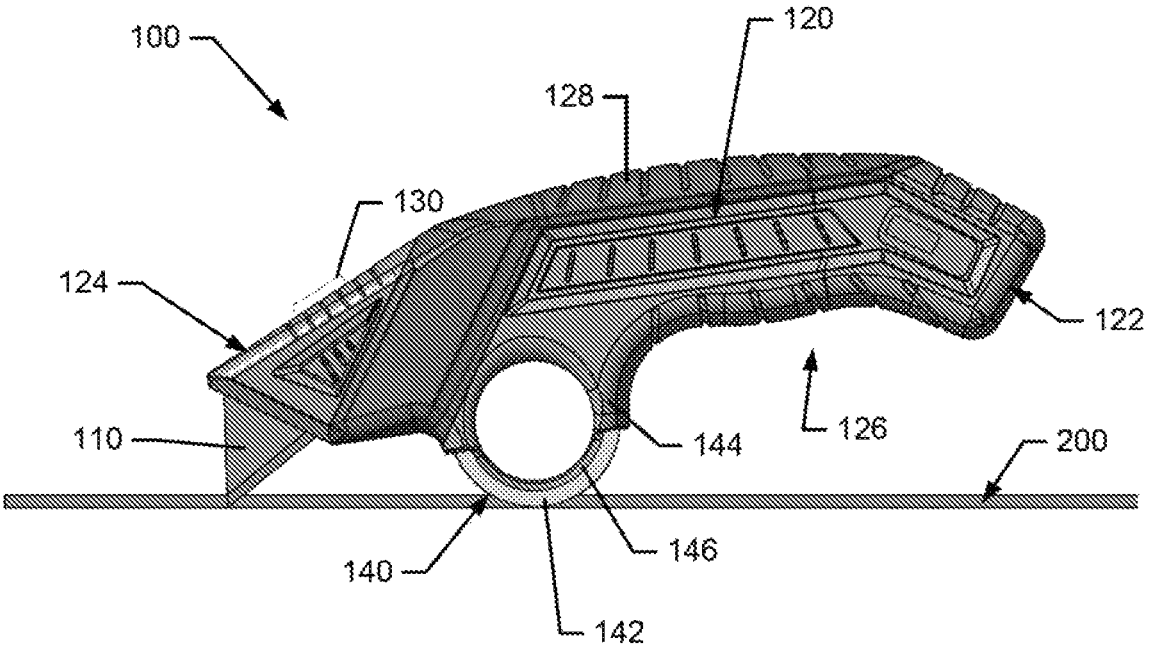
FIG. 1 illustrates a side view of a rolling utility knife according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of a rolling utility knife that offers improved protection for the knuckles of the operator and improved ability for users to make long, straight cuts on various types of materials. As shown in FIG. 1, a utility knife 100 may include a blade 110 (e.g., a retractable or non-retractable blade) that is operably coupled to a body portion 120 (or housing). The body portion 120 may include a heel portion 122 disposed at an opposite end (i.e., a rear end) of the utility knife 110 relative to an end (i.e., a front end) of the utility knife 100 from which the blade 110 is extendable. A sleeve portion 124 may be disposed at the front end of the utility knife 100, and the sleeve portion 124 may extend around the blade 110 and provide support for the blade 110 when the blade 110 is employed for cutting. Meanwhile, the sleeve portion 124 may house the blade 110 (fully or partially) when/if the blade 110 is retracted into the body portion 120. The body portion 120 may also define a grip portion 126 into which the fingers of the user (or operator) are provided when the utility knife 100 is used for cutting. The grip portion 126 may be disposed on an opposite side of the body portion 120 relative to a spine or back 128 of the body portion 120.

In an example embodiment, the blade 110 may be retractable based on the operation of a slide mechanism 130 that may be disposed at the body portion 120. Although the slide mechanism 130 of the example of FIG. 1 is disposed at the sleeve portion 124, the slide mechanism 130 could alternatively be located at any other suitable portion of the body portion 120 (e.g., along the back 128 or the heel portion 122). When a position of the slide mechanism 130 is adjusted, internal linkages provided to the blade 110 may be employed to ensure that the blade 110 is correspondingly also adjusted. Generally, forward movement of the slide mechanism 130 may result in further extension of the blade 110 out of the sleeve portion 124. The slide mechanism 130 is shown in dashed lines in FIG. 1 because the slide mechanism 130 may be omitted in some embodiments (e.g., as shown in FIGS. 2-7).

To facilitate stability while cutting, and protection for portions of the hand of the user, a wheel assembly 140 may be disposed at the grip portion 126. The wheel assembly 140 may include a wheel 142 that is operably coupled to the utility knife 100 via a wheel housing 144. The wheel housing 144 may extend away from some part of the grip portion 126 and allow the wheel 142 to be at least partially retained by the wheel housing 144 while also being at least partially exposed from the wheel housing 144. In some embodiments, the wheel housing 144 may enclose more than half of the perimeter of the wheel 142, while remaining portions of the wheel 142 are exposed. An interior surface of the wheel housing 144 may form a hub 146 about which the wheel 142 rotates freely. Thus, an inner diameter of the wheel 142 may be slightly larger than an outer diameter of the hub 146 of the wheel housing 144 to enable the wheel 142 to freely rotate about the hub 146 that is effectively formed by formation of the interior surface of the wheel housing 144 to have an annular shape. An outer diameter of the wheel 142 may be provided with a gripping surface (e.g., radially extending teeth, grooves, projections, etc.) to further facilitate movement of the wheel 142 over material 200 being cut or a cutting surface.

The hub 146 may form a complete circular or annular shape in some cases. However, in others, the hub 146 need not necessarily be a complete circle so long as sufficient structure is provided to enable the wheel 142 to be secure and also freely rotate on the hub 146. In some embodiments, the hub 146 and/or the wheel housing 144 may be formed to define a channel 150 (see FIG. 2) that allows axial movement of the wheel 142 about the hub 146 to at least some degree. The channel 150 may be defined by sidewalls on opposing faces to bound axial movement of the wheel 142 along the hub 146. Thus, while the wheel 142 may be free to move radially about a rotation axis defined at a center of the hub 146, the wheel 142 may also be enabled to move in an axial direction to alter its alignment relative to the blade 110.

Figure 2:
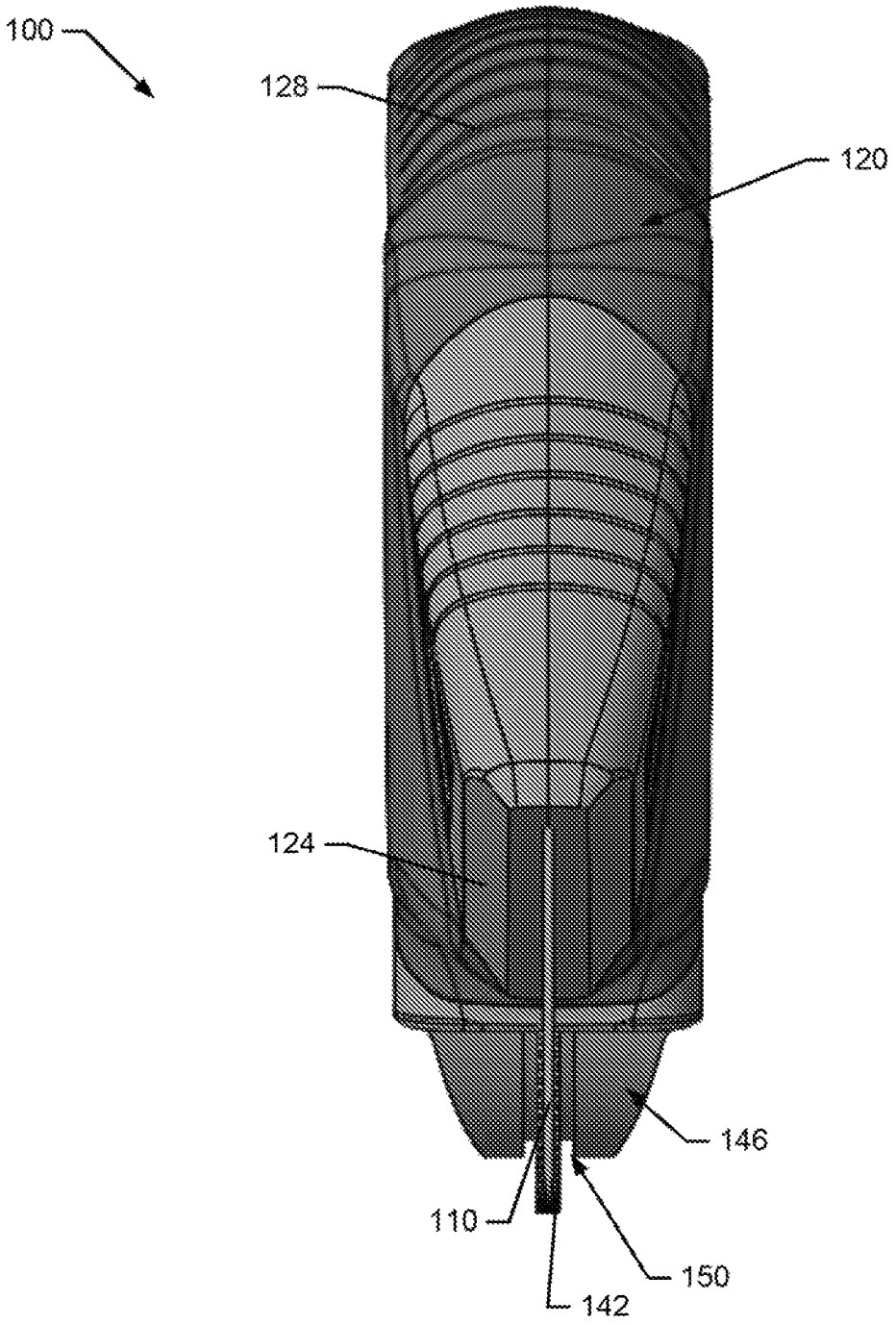
FIG. 2 illustrates a front view of the rolling utility knife when cutting a material without a straight edge according to an example embodiment.

In an example embodiment, the blade 110 may lie in a plane that substantially extends along a longitudinal axis of the utility knife 100. Meanwhile, the wheel 142 may, regardless of an axial position of the wheel 142 along the hub 146 or within the channel 150, always radially rotate (in either direction) while staying in a plane substantially parallel to the plane in which the blade 110 lies. In the example of FIG. 2, the blade 110 lies in approximately the same plane as the wheel 142. However, the width of the wheel 142 is generally provided to be less than the width of the channel 150 in order to allow the wheel 142 to move axially within the channel 150 between the sidewalls. Such movement of the wheel 142 may enable the wheel 142 to lie in planes different than the plane in which the blade 110 lies. This axial movement of the wheel 142 may be particularly advantageous for enabling the wheel 142 to move along and maintain alignment with a straight edge along which it may be desirable for the blade 110 to cut.

Given that the width of the wheel 142 is larger than the width of the blade 110, it should be appreciated that if the channel 150 and wheel 142 had substantially the same width, the wheel 142 would not be allowed to move axially about the hub 146. Accordingly, if the blade 110 was to be used to cut along a straight edge, either a misalignment would be created between the blade 110 as the blade 110 runs along the straight edge or the wheel 142 would extend over the straight edge and create the potential to change the alignment of the blade 110 relative to the straight edge as the wheel 142 moved laterally over the top surface of the straight edge or fell of the straight edge during the cutting process. To prevent this misalignment, the wheel 142 is allowed to move axially to align with the straight edge so that an edge of the blade 110 that contacts the straight edge and an edge of the wheel 142 that contacts the straight edge can each be in the same plane.

Figure 3:
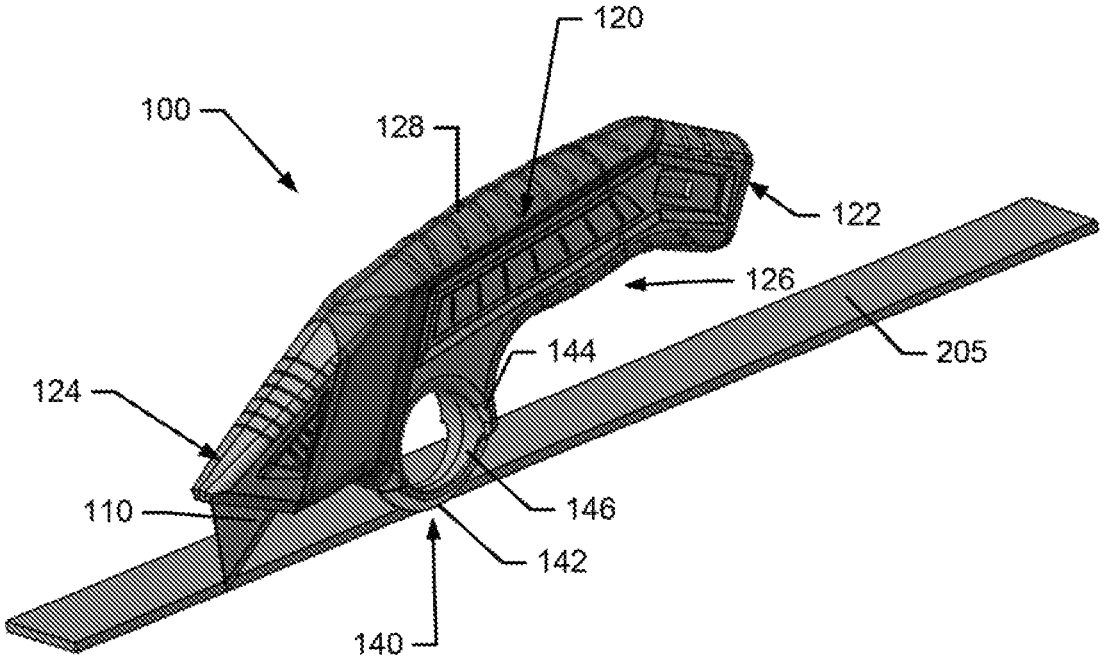
FIG. 3 illustrates the perspective view of the rolling utility knife used in connection with a straight edge located to the right of the blade according to an example embodiment.
Figure 4:
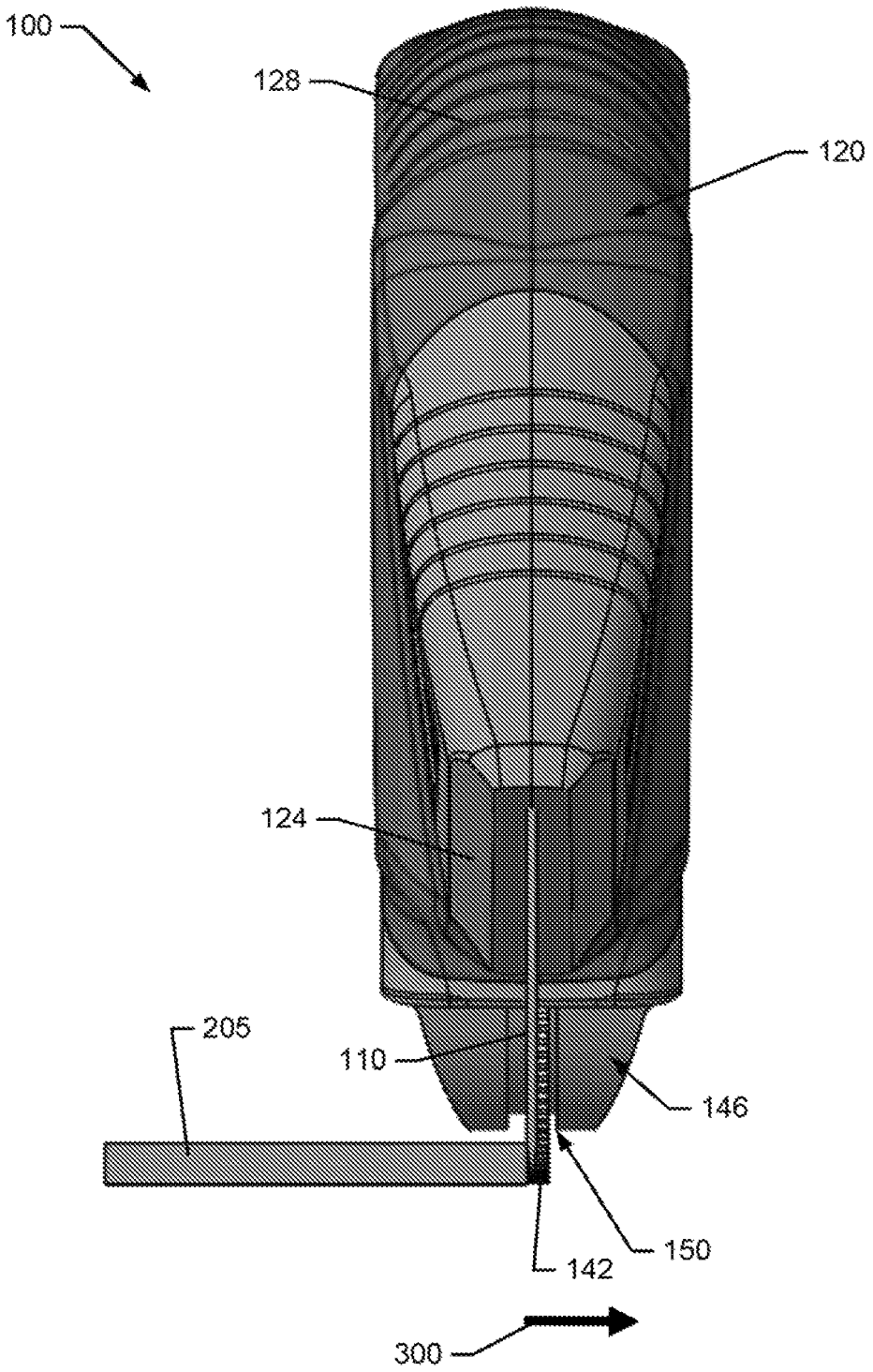
FIG. 4 illustrates a front view of the rolling utility knife with the wheel of the knife offset laterally to ride the straight edge of the example of FIG. 3 according to an example embodiment.
Figure 5:
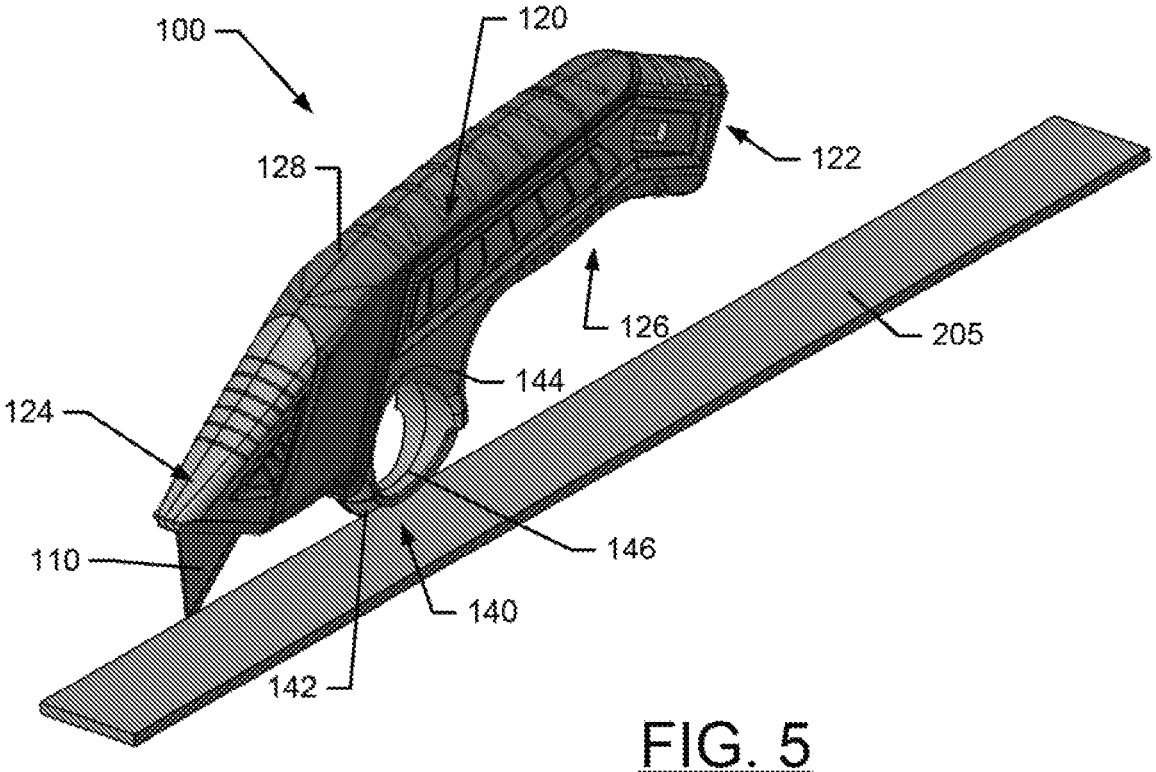
FIG. 5 illustrates the perspective view of the rolling utility knife used in connection with a straight edge located to the left of the blade according to an example embodiment.
Figure 6:
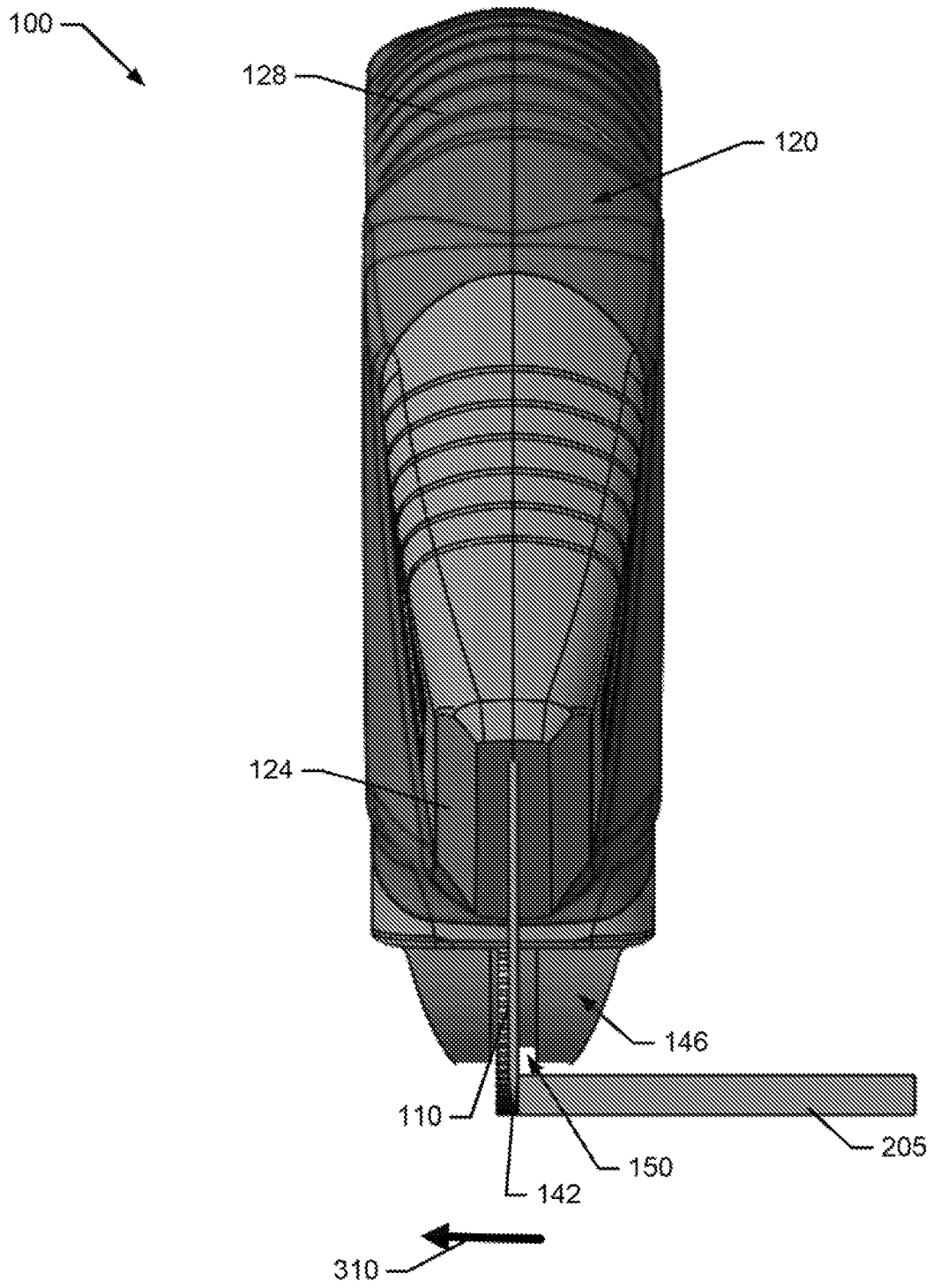
FIG. 6 illustrates a front view of the rolling utility knife with the wheel of the knife offset laterally to ride the straight edge of the example of FIG. 5 according to an example embodiment.

FIGS. 3 and 4 illustrate such an example in which a straight edge 205 is provided on the right side of the blade 110 during a cutting operation. In the example of FIGS. 3 and 4, the wheel 142 moves axially in the direction of arrow 300 (see FIG. 4) to allow the wheel 142 to run alongside the straight edge 205 during the cutting operation. In particular, the wheel 142 moves axially in the direction of arrow 300 to align the edge of the wheel 142 that contacts the straight edge 205 with the edge of the blade 110 that contacts the straight edge 205. Meanwhile, FIGS. 5 and 6 illustrate an example in which a straight edge 205 is provided on the left side of the blade 110 during a cutting operation. In the example of FIGS. 5 and 6, the wheel 142 moves axially in the direction of arrow 310 (see FIG. 6) to allow the wheel 142 to run alongside the straight edge 205 during the cutting operation. In particular, the wheel 142 moves axially in the direction of arrow 300 to align the edge of the wheel 142 that contacts the straight edge 205 with the edge of the blade 110 that contacts the straight edge 205.

Although not required, the width of the wheel 142 may be selected to substantially equal to half the width of the channel 150. Moreover, in some cases, the width of the wheel 142 may be selected to be substantially equal to the distance between a left sidewall of the channel 150 and a right edge of the blade 110 (which is also substantially equal to the distance between the right sidewall of the channel 150 and the left edge of the blade 110). Thus, the wheel 142 may be maintained in position axially between the edge of the straight edge 205 and the sidewall that faces the straight edge while the wheel 142 rotates about the hub 146. The wheel 142 may therefore be substantially maintained in its position to facilitate alignment and stability of the orientation of the blade 110 as the blade 110 passes along the straight edge 205. For example, for a blade having a width of 0.025", the wheel 142 may have a width of about 0.05" and the channel 150 may have a width of about 0.12". Thus, in some cases, the wheel 142 may have a width of about 2× the width of the blade 110 (e.g., in a range of 1.7× to 2.3×). Meanwhile, the channel 150 may have a width of about 2× the width of the width of the wheel 142 plus ½ the width of the blade 110 (e.g., in a range of 1.7× to 2.3×). Thickness of the wheel 142 may be increased in order to provide a larger bearing surface to add increased stability in some cases. Thus, the width of the channel 150 could be determined based on the ranges set for the above.

In some embodiments, the grip portion 126 may be recessed slightly relative to other structures of the body portion 120. For example, the wheel housing 144 (and also the wheel 142) may extend away from the body portion 120 (e.g., downward toward the material 200 being cut or cutting surface) and the heel portion 122 may also be slightly extended away from the body portion 120 (e.g., in the downward direction). This arrangement generally allows the fingers of the user to be protected both from the front and rear directions so that impact with the material 200 or cutting surface can be prevented. Moreover, in some examples, the user may actually place at least one finger (e.g., the pointer finger) within the wheel housing 144 for further protection. Although the example of FIG. 1 shows the wheel housing 144 disposed at a front part of the grip portion 126, it should be appreciated that the wheel housing 144 could alternatively be placed at another portion of the grip portion 126 to correspond to a different finger (or even be sized to fit multiple fingers).

Figure 7:
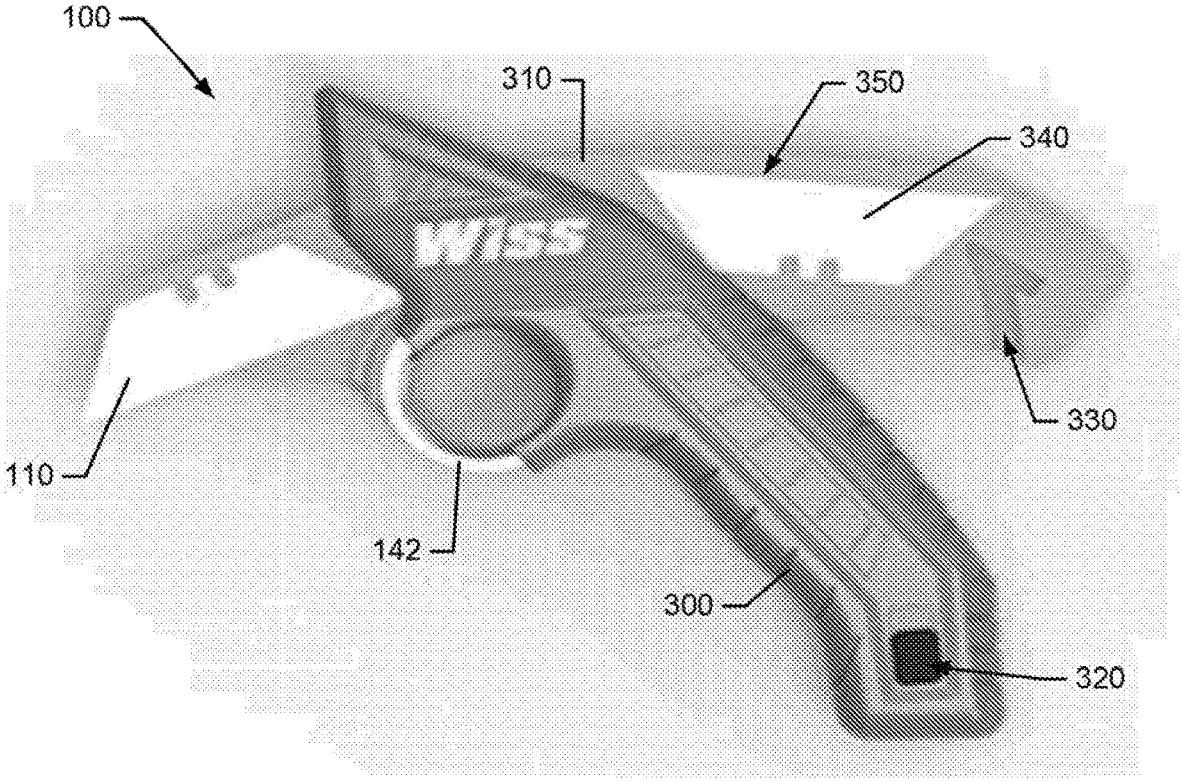
FIG. 7 illustrates a side view of the rolling utility knife rotated to a blade change position in accordance with an example embodiment.

In some examples, the body portion 120 may be divided into two sides (e.g., right side 300 and left side 310) that can rotate relative to each other as shown in FIG. 7. In such an example, a locking mechanism 320 may be provided (e.g., at the heel portion 124) to allow the right and left sides 300 and 310 of the body portion 120 to be locked relative to each other or released. As can be appreciated from FIG. 7, when the locking mechanism 320 is rearwardly positioned, the right and left sides 300 and 310 may be aligned together and held in such alignment. However, when the locking mechanism 320 is moved forward, a channel 330 may be formed in one or both of portions the right and left sides 300 and 310 that face each other to allow the right side 300 to pivot relative to the left side 310 since a projection associated with the locking mechanism 320 can pass through the channel 330 in this alignment. Extra blades (e.g., extra blade 340) may be housed within a reception space 350 provided in one or both of portions the right and left sides 300 and 310 that face each other as well. In an example embodiment, the right and left sides 300 and 310 may pivot relative to each other by a predetermined amount (e.g., 45 degrees) about a pivot axis of the wheel 142. Thus, as can be appreciated from the descriptions herein, the blade 110 may be retractable or fixed and, when fixed, replacement blades may be stored within the body portion 120. However, it should also be appreciated that the blade 110 may be embodied as a quick change blade in some embodiments.

Example embodiments allow for the provision of a utility knife that is able to roll along a surface being cut, while facilitating maintenance the alignment of the blade (with or without a straight edge or other guiding surface). Such a utility knife may include a body portion having a sleeve portion at a first end thereof and a heel portion at a second end thereof, and a blade that extends from the sleeve portion. The body portion may include a wheel assembly including a wheel rotatably disposed about a hub. The wheel may be configured to support the utility knife during a cutting operation relative to a material being cut. The wheel may be disposed on the hub to enable axial movement of the wheel to change an alignment of the wheel relative to the blade. The utility knife may allow for lateral (or axial) movement of the wheel so that an ambidextrous design is provided to support users cutting without the assistance of a guide or straight edge, or with such assistance on either side of the blade.

The utility knife and/or its components may include a number of modifications, augmentations, or optional additions, some of which are described herein. For example, the hub may define a channel inside which the wheel rotates. A width of the channel and a width of the wheel may be defined to enable the wheel to lie in a same plane with the blade or lie in a different plane than the blade responsive to the axial movement of the wheel. In some cases, the wheel may be enabled to lie in a first plane on one side of a plane in which the blade lies or a second plane on an opposite side of the plane in which the blade lies. In some example embodiments, the width of the wheel may be substantially half the width of the channel. Alternatively, the width of the wheel may be substantially equal to a distance between a first sidewall of the channel a face of the blade that faces away from the first sidewall. In an example embodiment, the hub may be defined by a wheel housing disposed at a grip portion of the body portion. In some cases, the wheel housing may be configured to receive a finger of a user of the utility knife during a cutting operation. In some examples, the wheel housing may be disposed proximate to the first end of the utility knife and the heel portion may extend downward at the second end of the utility knife to define the grip portion as a recessed portion of the utility knife. In an example embodiment, the blade may be retractable based on the operation of a slide mechanism. In some cases, the slide mechanism may be disposed at the heel portion of the utility knife. In an example embodiment, the wheel and the hub may each have an annular shape and an inner diameter of the wheel may be slightly larger than an outer diameter of the wheel hub. In some cases, an outer diameter of the wheel may be provided with a gripping surface.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A utility knife comprising:

a body portion including a sleeve portion at a first end thereof and a heel portion at a second end thereof; and a blade that extends from the sleeve portion, wherein the body portion comprises a wheel assembly including a wheel rotatably disposed about a hub, the wheel being configured to support the utility knife during a cutting operation relative to a material being cut, wherein the wheel is disposed on the hub to enable axial movement of the wheel to change an alignment of the wheel relative to the blade, and wherein the hub defines a channel inside which the wheel rotates, and wherein a width of the channel and a width of the wheel are defined to enable the wheel to lie in a same plane with the blade or lie in a different plane than the blade responsive to the axial movement of the wheel.

2. The utility knife of claim 1, wherein the wheel is enabled to lie in a first plane on one side of a plane in which the blade lies or a second plane on an opposite side of the plane in which the blade lies.

3. The utility knife of claim 1, wherein the width of the wheel is substantially half the width of the channel.

4. The utility knife of claim 1, wherein the width of the wheel is substantially equal to a distance between a first sidewall of the channel a face of the blade that faces away from the first sidewall.

5. The utility knife of claim 1, wherein the hub is defined by a wheel housing disposed at a grip portion of the body portion.

6. The utility knife of claim 5, wherein the wheel housing is configured to receive a finger of a user of the utility knife during a cutting operation.

7. The utility knife of claim 6, wherein the wheel housing is disposed proximate to the first end of the utility knife and the heel portion extends downward at the second end of the utility knife to define the grip portion as a recessed portion of the utility knife.

8. The utility knife of claim 1, wherein the blade is retractable based on the operation of a slide mechanism.

9. The utility knife of claim 8, wherein the slide mechanism is disposed at the sleeve portion of the utility knife.

10. The utility knife of claim 1, wherein the wheel and the hub each have an annular shape and an inner diameter of the wheel is slightly larger than an outer diameter of the hub.

11. The utility knife of claim 10, wherein an outer diameter of the wheel may be provided with a gripping surface.

12. The utility knife of claim 1, wherein the body portion includes a right side and a left side that are rotatable relative to each other about a rotational axis of the wheel.

13. The utility knife of claim 12, wherein the right and left sides of the body portion are rotatable based on a position of a locking mechanism.

14. The utility knife of claim 13, wherein the locking mechanism comprises a slidable component disposed proximate to the heel portion of the body portion, the left and right sides being held together when the locking mechanism is in a first position and being allowed to rotate relative to each other when the locking mechanism is in a second position.

15. The utility knife of claim 12, wherein one or both of the left side and right side includes a reception space in which one or more extra blades are configured to be stored.

16. A wheel assembly of a utility knife, the utility knife including a body portion including a sleeve portion at a first end thereof and a heel portion at a second end thereof, the utility knife further including a blade that extends from the sleeve portion, the wheel assembly comprising a hub and a wheel rotatably disposed about the hub, wherein the wheel is configured to support the utility knife during a cutting operation relative to a material being cut, wherein the wheel is disposed on the hub to enable axial movement of the wheel to change an alignment of the wheel relative to the blade, and wherein the hub defines a channel inside which the wheel rotates, and wherein a width of the channel and a width of the wheel are defined to enable the wheel to lie in a same plane with the blade or lie in a different plane than the blade responsive to the axial movement of the wheel.

17. The wheel assembly of claim 16, wherein the wheel is enabled to lie in a first plane on one side of a plane in which the blade lies or a second plane on an opposite side of the plane in which the blade lies.

18. The utility knife of claim 16, wherein the hub is defined by a wheel housing disposed at a grip portion of the body portion.

* * * * *